US008403534B2

(12) United States Patent
Van Bommel et al.

(10) Patent No.: US 8,403,534 B2
(45) Date of Patent: Mar. 26, 2013

(54) LIGHTING SYSTEM, LIGHT ELEMENT AND DISPLAY

(75) Inventors: Ties Van Bommel, Eindhoven (NL); Rifat Ata Mustafa Hikmet, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 25 days.

(21) Appl. No.: 12/864,908

(22) PCT Filed: Feb. 2, 2009

(86) PCT No.: PCT/IB2009/050393

§ 371 (c)(1),
(2), (4) Date: Jul. 28, 2010

(87) PCT Pub. No.: WO2009/098620

PCT Pub. Date: Aug. 13, 2009

(65) Prior Publication Data

US 2010/0321937 A1 Dec. 23, 2010

(30) Foreign Application Priority Data

Feb. 4, 2008 (EP) ..... 08151014

(51) Int. Cl.
*F21S 4/00* (2006.01)
*F21V 21/00* (2006.01)

(52) U.S. Cl. ..... 362/249.03; 362/249.02; 313/498; 313/506

(58) Field of Classification Search ..... 313/498–512; 362/249.02, 249.03, 249.04, 800, 458
See application file for complete search history.

(56) References Cited

U.S. PATENT DOCUMENTS

| | | | | |
|---|---|---|---|---|
| 3,978,934 | A | 9/1976 | Schneidinger | |
| 5,218,351 | A | 6/1993 | Hashikawa | |
| 7,997,774 | B2 * | 8/2011 | Liddle | 362/398 |
| 2008/0151542 | A1 * | 6/2008 | Liddle | 362/240 |
| 2009/0086478 | A1 * | 4/2009 | Sanroma et al. | 362/234 |
| 2011/0019418 | A1 * | 1/2011 | Sanroma et al. | 362/249.02 |

FOREIGN PATENT DOCUMENTS

| | | | |
|---|---|---|---|
| DE | 20204263 | U1 | 7/2003 |
| DE | 102004039897 | A1 | 3/2006 |
| GB | 2423144 | A | 8/2006 |
| JP | 11066916 | | 3/1999 |
| JP | 2000010029 | | 1/2000 |
| WO | 2004084683 | A1 | 10/2004 |
| WO | 2007057456 | A1 | 5/2007 |

* cited by examiner

*Primary Examiner* — Anne Hines
*Assistant Examiner* — Jose M Diaz
(74) *Attorney, Agent, or Firm* — David Zivan; Mark Beloborodov

(57) ABSTRACT

The invention relates to a lighting system, a light element for use in such system, and a display comprising such a lighting system. The lighting system comprises light elements (5) such as LEDs or OLEDs, located between two preferably transparent substrates (2, 3) provided with an electrically conducting layers. The light element has sliding electrical contacts, enabling movement of the light element between the substrates while being lit. Such a system provides a relatively simple lighting system allowing for easy modification.

13 Claims, 9 Drawing Sheets

LIGHTING SYSTEM, LIGHT ELEMENT AND DISPLAY

FIELD OF THE INVENTION

The invention relates to a lighting system, a light element for use in such system, and a display comprising such a lighting system.

BACKGROUND OF THE INVENTION

Lighting systems such as general lighting systems, decorative lighting systems and signposts, typically comprise electrical light elements including inorganic light emitting diodes (LEDs), organic light emitting diodes (OLEDs) or lasers. Said light elements are mounted on a fixed holder comprising an anode and cathode needed for power supply of the light element.

There is an increasing need for flexible lighting systems wherein the appearance of the emitted light is easily modified by users, and which allows users to do so in a creative way. A disadvantage of the known systems is that modifications can only be achieved by either moving the mount or by the introduction of technically advanced systems that divert the light from the fixed lighting elements in a dynamic way. Such systems are often complex in operation, take up relatively much space and typically limit the creativity of the users.

It is an object of the invention to provide a relatively simple lighting system allowing for relatively easy modification.

SUMMARY OF THE INVENTION

The invention provides a lighting system, comprising at least a first substrate and a second substrate enclosing a space, wherein at least one part of the first and second substrates is at least partially transparent, wherein the space between the substrates comprises at least one electrical light element, wherein the light element is displaceable with respect to the substrates, wherein the substrates comprise electrical power means, wherein the light element is provided with sliding electrical connectors for powering the light element in sliding electrical contact with the electrical power means. Such a system provides a relatively simple lighting system allowing for relatively easy modification of the position of the light element. Preferably, the substrates run essentially parallel. The substrates may be flat surfaces, but may also be partly curved. The electrical power means may be made of any suitable electrically conducting material. Typically, the power means comprise an anode and a cathode, and may be powered by either an alternating current (AC) or direct current (DC), and the light element would be selected to suit the available power supply. At least one of the first substrate and the second substrate is provided with an electrically powered cathode and anode. The cathode and anode may for instance be electrically conducting tracks formed on at least one of the substrates, or for instance a first substrate is provided with a cathode layer and the opposite substrate is provided with an anode layer. It is not necessary that the light element is electrically powered in all positions with respect to the substrates: in positions where no electrical power is available to the light element it will be switched off. The space between the substrates is suitable for accommodating sliding movement of the light element. The light element may for instance be an inorganic light emitting diode (LED), an organic light emitting diode (OLED), or a laser element, preferably suitable for emitting visible light (350 nm-750 nm). The light emitted from the light element when powered may be emitted either directly or indirectly through a transparent portion of the substrates. The sliding electrical connectors may include any suitable electrical contact means, including electrically conducting organs such as brushes, springs or rollers. Thus, the sliding electrical connector is to be interpreted in a broad sense and may involve for instance rolling action.

In a preferred embodiment, the lighting system comprises multiple light elements. Thus, a greater number of modification options is created. The lighting system may for instance comprise 10, 20, or even hundreds of displaceable lighting elements. The lighting elements may emit different colours. Multiple lighting elements may be grouped together, for instance in the form of letters, numbers or words.

It is preferred if at least part of the multiple light elements are displaceable independently of each other. Thus, it is relatively easy to form a great number of different letters, numbers, words and/or other graphical forms. A number of light elements each forming a light dot are particularly suitable for forming any possible graphical form, and thus offer great flexibility.

Preferably, the light system comprises at least one light element selected from the group consisting of inorganic light emitting diodes (LEDs), organic light emitting diodes (OLEDs) and lasers. Such light elements are readily available, but have to be adapted for sliding electrical contact within the system according to the invention.

In a preferred embodiment, both substrates are at least partially transparent. Thus, the light may emit through transparent portions of both substrates, enlarging the visibility of the light contacts. In such case, preferably transparent anodes and cathodes are used, which are known in the art. Most preferably, both substrates are completely transparent. One known example of this type of lighting device is a so-called "LED in glass" device in which the light emitted by the light source may emit through the transparent portions of both substrates.

In a preferred embodiment, the first substrate is transparent and the second substrate, opposite to the transparent substrate, is provided with a reflective surface. Thus, the light intensity as perceived by a user is optimised.

Preferably, the first substrate is transparent, and the second substrate opposite to the transparent substrate is provided with a metallic surface. The advantage of using a metal substrate is improved thermal management which might be needed in case the lighting device comprises a plurality of LEDs. The metallic surface may also be light-reflective.

It is preferred if at least one anode and at least one cathode cover adjacent areas on the same substrate, wherein the connectors of the light element are adapted to contact the anode and the cathode simultaneously in a connecting position. Hence, only one of the substrates needs to be provided with electrical power means (anode and cathode). It is conceivable that the light element can also be moved to a non-connecting position wherein the contact elements of the light element do not contact the anode and cathode. Hence it is possible to turn the light element on and of by displacing the light element with respect to the substrates.

Preferably, a first connector of the light element is located at a distal end of the light element, and a second connector of the light element is located at another distal end of the light element, opposite to the first connector.

In a preferred embodiment, at least one anode covers at least part of a first substrate, and at least one cathode covers at least part of the opposite substrate, wherein the connectors of the light element are adapted to contact the anode and the cathode simultaneously in a connecting position. Having the anode and cathode on opposite substrates provides an improved flexibility towards the positions wherein the lighting element is electrically powered e.g. is connected to both an anode and a cathode.

Preferably, a first connector of the light element is located on top of the light element, and a second connector of the light element is located on the bottom of the light element, opposite to the first connector.

It is advantageous if the anode and/or the cathode only cover part of the substrate, such that in at least a 'on' position with respect to the substrate the connectors means connect to both the anode and the cathode, powering the light element, whereas in at least an 'off' position with respect to the substrate the connectors means do not connect both the anode and the cathode. This enables switching a specific light element on or off by moving the light element to a specific position or area on the substrate. In addition, it is also possible to adapt the intensity of the light by providing anodes/cathodes with a different electrical potential at different positions on the substrate.

In a preferred embodiment, the lighting system comprises different anodes and/or cathodes having a different electrical potential located at different positions, such that electrical power supplied to the light element depends on the position of the light element. Such a system offers creative possibilities to the user, enabling easy modification of the amount of emitted light from a specific light element depending on the position of the lighting element with respect to the substrate.

It is preferred if the light element is provided with biasing means for biasing the connecting means against the anode and/or the cathode. Thus, a very reliable sliding electrical contact of the lighting element with the anode and cathode is possible. The biasing means may for instance comprise a spring element pushing an electrical contact element against the anode or cathode. Alternatively, the biasing means are integrated with the connecting means. For instance, the biasing means could be a spring formed out of an electrical connector.

It is preferred if the lighting system is provided with fixing means for fixing the light element on a predetermined position with respect to the substrate. Hence it is very easy to maintain a predetermined position of the light element. The fixing means could be mechanical, for instance based on a biasing means clamping the light element between the substrates. However, the fixing means could also employ a magnetic or electrical field in order to stabilize the position of a suitably adapted light element. The fixing means are particularly useful when the substrates are to be directed in a vertical way, wherein the fixing means need to be sufficiently powerful to withstand gravity.

Advantageously, the system is provided with driving means for displacing the light element. Such driving means allow for easy displacement of the light elements. In a preferred embodiment, the light element could be magnetically susceptible, and the driving means comprise a displaceable magnet for moving the magnetically susceptible light element. Alternatively, the light element could be susceptible to electrical field, and the driving means comprise electrical field generators capable of displacing the light element. In yet another alternative embodiment, the space between the substrates comprises a fluid medium, and the driving means comprise pumping means for generating a flow in the fluid medium capable of moving the light element. Such systems could also be employed to achieve dynamic light effects.

Advantageously, at least part of the substrates is provided with light-modifying means. Thus, it is easy to change the appearance of light emitted by the system. The light-modifying means preferably comprise at least one optical element selected from the group consisting of a colour filters, a light diffuser, a light reflectors, refractive elements, diffractive elements and luminescent elements. The luminescent elements may comprise organic and inorganic luminescent and phosphorescent materials. By providing different light-modifying means at different positions on the substrate, the light characteristics as perceived by a user, for instance the light distribution and the colour (temperature) of the light, can be changed by displacing the light elements with respect to the substrate.

The invention further provides a light element provided with at least one sliding electrical connector for use in a lighting system according to the invention.

The invention also provides a display comprising a lighting system according to the invention. Such a toy allows a user for arranging the positions of at least one, but preferably multiple, light elements. The system allows creative entertainment, for instance the formation of letters, numbers, words or graphical representations, by simply rearranging the light elements. The display may for instance be used in a toy, an entertainment system or as a light-emitting sign board that can easily be modified.

The invention will now be further elucidated by the following non-limiting examples. Any reference signs in the claims should not be construed as limiting the scope.

DETAILED DESCRIPTION OF EMBODIMENTS

Figure 1A:
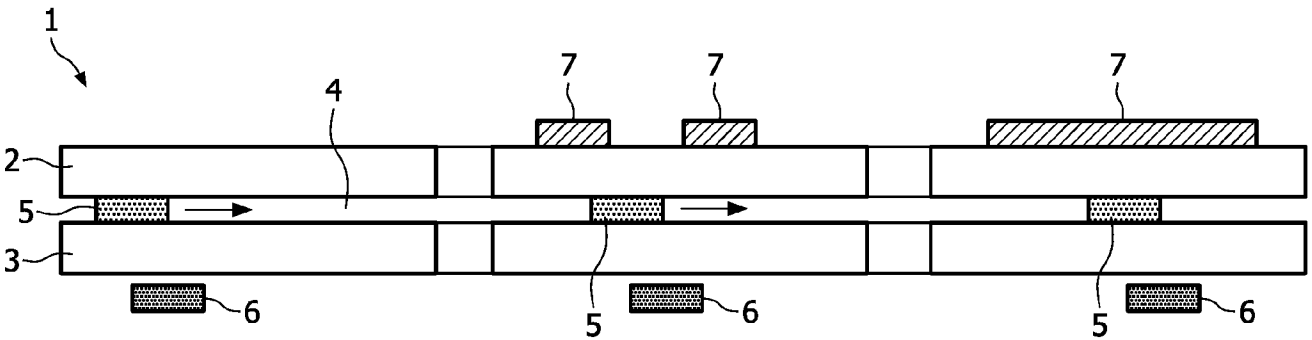
FIGS. 1,*a,b* show two embodiments of a magnetic version of the light system according to the invention.

FIG. 1*a* shows a light system 1 according to the invention, comprising a first transparent plate 2 and a second transparent plate 3 enclosing a space 4. The transparent plates or substrates are coated with an electrically conducting material (for instance transparent conductive coating from e.g. ITO, metal tracks from e.g. copper or a doped semiconductor material) forming at least one anode and at least one cathode, which can be arranged in many different ways as will be explained below. The electrically conducting material supplies electrical power to a light element 5, for instance a LED or OLED, arranged in the space 4 between the parallel plates 2, 3. The light element 5 is displaceable with respect to the substrates 2, 3, and has sliding electrical contacts such as brushes, for powering the light element in sliding electrical contact with a cathode and an anode. It is possible to provide one of the plates 2, 3 with an anode and the opposite plate with the cathode, but it is also possible to arrange both the anode and cathode on one of the plates. The light element 5 comprises a magnetically susceptible metal, and can be moved between the plates 2, 3 by moving an external magnet 6 in close proximity of the light element 5. Multiple light elements 5 can be arranged in the space 4 between the plates 2, 3. Optionally, the transparent plates 2, 3 can be provided with additional optical elements 7 for additional optical effects on light emitted by the light element 5. Optical elements 7 may cover part or the whole of the transparent section, and may include various optical functionalities such as filters, reflectors, diffusers, refractive elements, diffractive elements, as well as luminescent elements that may comprise organic and/or inorganic luminescent and phosphorescent particles or dyes, that can me excited by the radiation from the light element 5. Instead of a magnetic field, also other displacement means may be used to move the light element 5, as will be shown below.

Figure 1B:
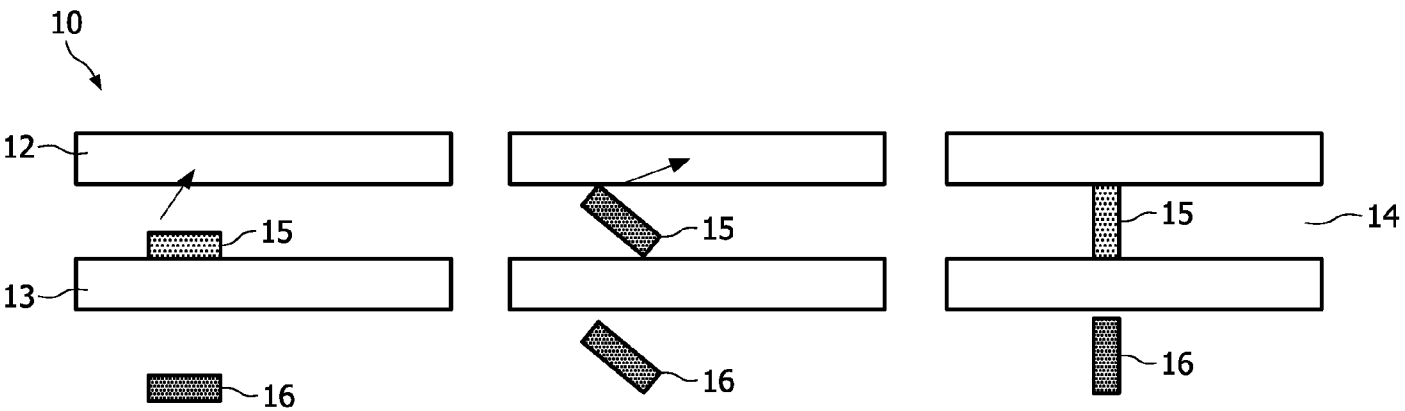
Figure 2A:
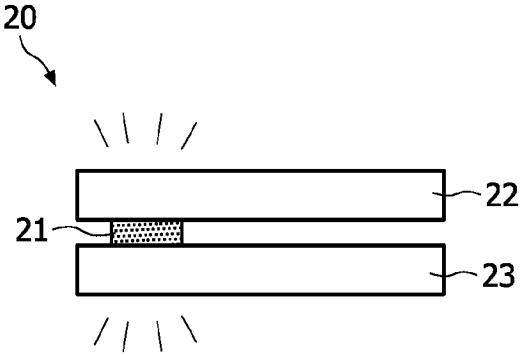
FIG. 2 shows another embodiment of the invention.
Figure 2B:
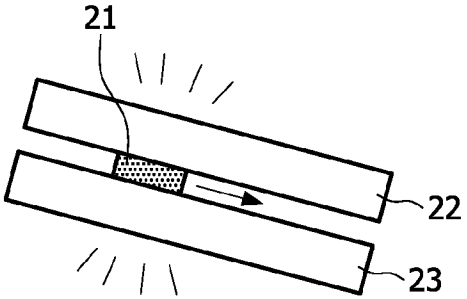
Figure 2C:
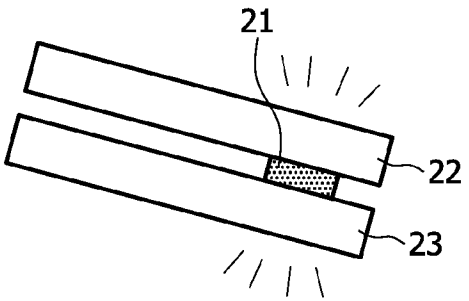
Figure 2D:
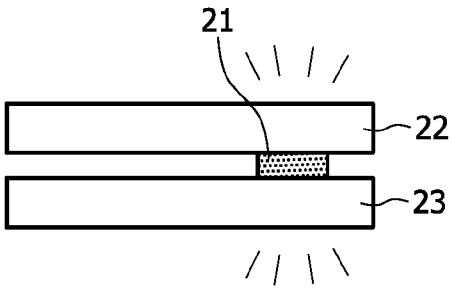

FIG. 1*b* shows another embodiment a light system 10, comparable to FIG. 1*a*, wherein the space 14 between the plates 12, 13 is larger, enabling the light element 15 not only to translate as shown in FIG. 1*a*, but also to rotate under the influence of a magnetic field exerted by external magnetic means 16. Hence, in this case the magnetic means can be used to establish an electrical contact, between the plates 12, 13, allowing for switching the light element 15 on and of. In this case, the top plate 12 is provided with an anode and the bottom plate 13 is provided with a cathode. The light element 15 is shown in the 'off' orientation on the left side, while on the right side it is in the 'on' position connecting the anode and the cathode.

FIG. 2 shows another embodiment of the invention, comparable to FIG. 1, wherein the light system 20 comprising a light element 21 such as a LED arranged between electrically conducting transparent plates 22, 23 is displaced under the influence of gravity. The light element 21 is moved from a first position (FIG. 2*a*), by simply tilting the plates (b, c), making the light element slide to another position (FIG. 2*d*). While sliding, the light element 21 retains electrical contact with the plates 22, 23 and continues to emit light.

Figure 3A:
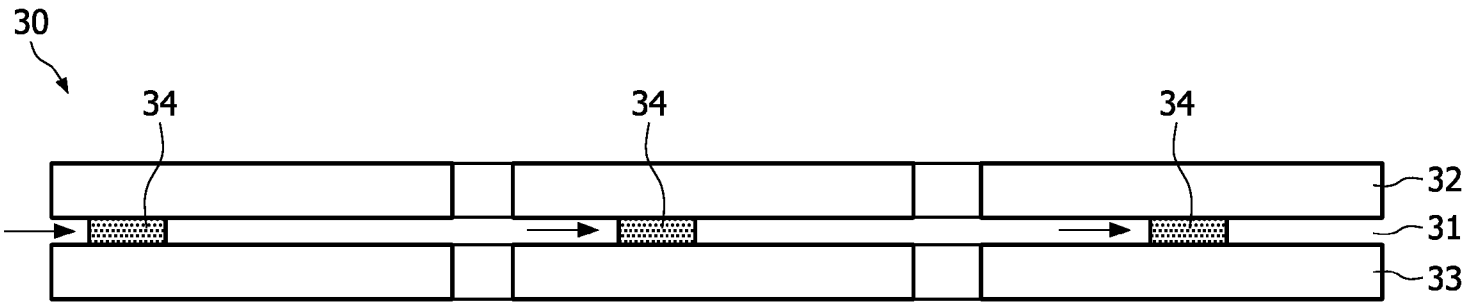
FIGS. 3*a,b* show two different embodiments of the light system according to the invention.

FIG. 3*a* shows another embodiment of a light system 30, wherein the space 31 between the plates 32, 33 is medium-tight, and filled with a fluid medium, preferably a gas or liquid. By pumping the fluid through the space 31 a flow can be created that displaces the light elements 34 with respect to the substrates 32, 33. Such a flow of medium provides a relatively simple way to create dynamic light effects through a constant movement of light elements 34.

Figure 3B:
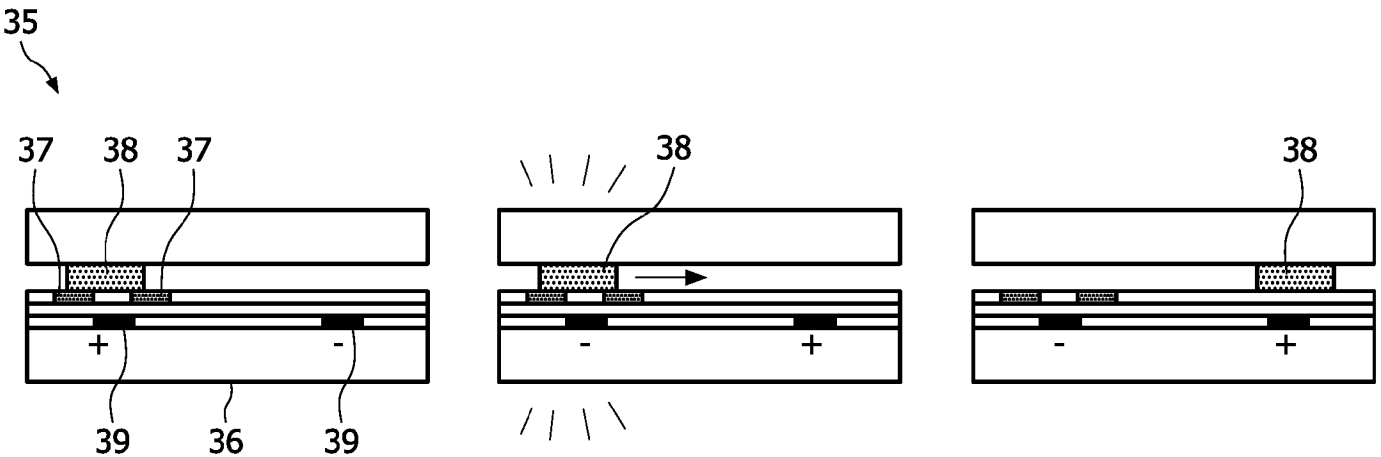

FIG. 3*b* shows an electric-field driven version of the light system 35 according to the invention. In this case, the bottom substrate 36 is provided with electrical tracks 37 for providing power to the light element 38, as well as electric field-creating tracks 39 capable of inducing an attracting or repulsing electric field at a predetermined location. In the figure, the light element 38 is in contact with the power supply wires 37 on the left side and emitting light. However, the light element 38 may be moved to another position (on the right side), where no power supply wires 37 are available, effectively switching the light element 38 off.

Figure 4:
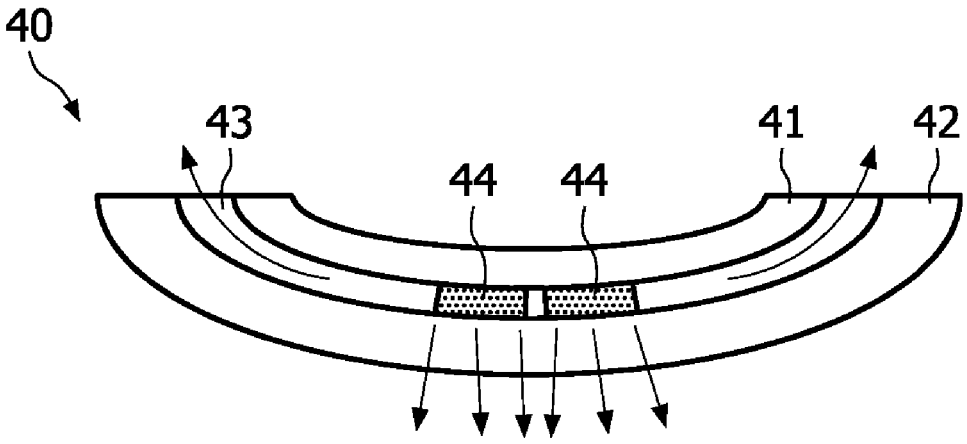
FIG. 4 shows a curved version of the light system according to the invention.

FIG. 4 shows a curved version of the light system 40 according to the invention, wherein two essentially parallel substrates 41, 42 define a space 43 wherein multiple displaceable light elements 44 are arranged. For such curved embodiments, OLEDs are particularly suitable as light elements 44, as OLEDs are available in flexible forms that easily accommodate to the curvature of the space 43.

Figures 5A, 5B:
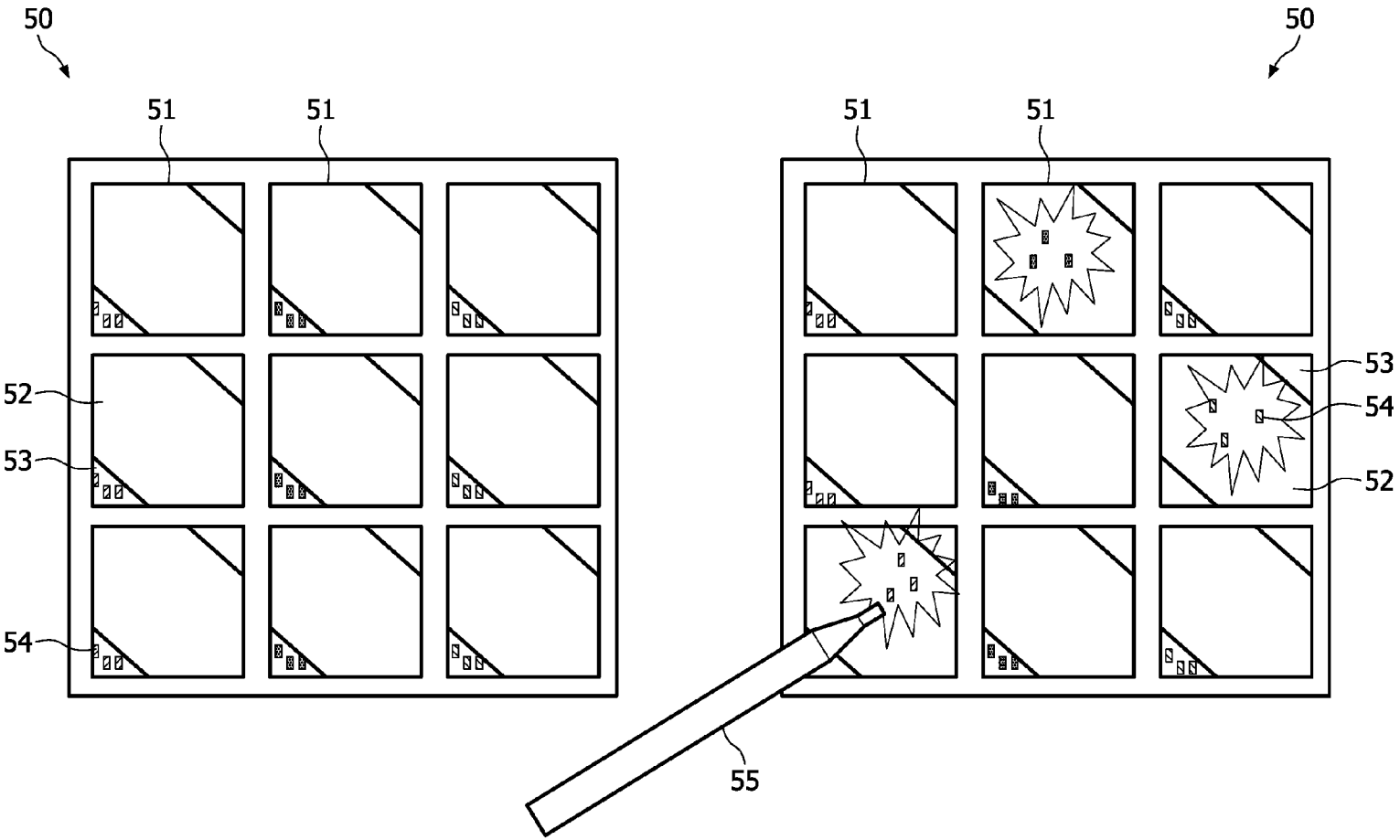
FIGS. 5*a,b* show a magnetic drawing board according to the invention.

FIGS. 5*a,b* show a magnetic drawing board 50 according to the invention, including multiple light systems 51 as described in the other figures. Each light system comprises an electrically powered zone 52, as well as a neutral zone 53 devoid of electrical power. In FIG. 5*a*, the light elements 54 (LEDs) are deposited in the neutral zones 53, and therefore do not emit light. However, by using a magnetic pencil 55 (see FIG. 5*b*), the LEDs can be displaced from the neutral zone 53 to the electrically powered zone 52 (as shown in for instance FIGS. 1, 2, 3, 4, 6, 7 and 8), resulting in the emitting of light for those LEDs that are in the electrically powered zone. The LEDs can be moved back into the neutral zone 53 in order to switch them off. Thus, this very flexible drawing board provides numerous creative and practical possibilities. The possibilities can be even further enhanced by the introduction of for instance light elements 54 in different colors and the addition of optical elements to the board 50. As the board 50 is typically only used from one side when for instance mounted on a wall or set on a table, it is preferred if the substrate closest to the user is transparent, whereas the back substrate is a reflector, used to improve the intensity of light as perceived by the user.

Figure 6A:
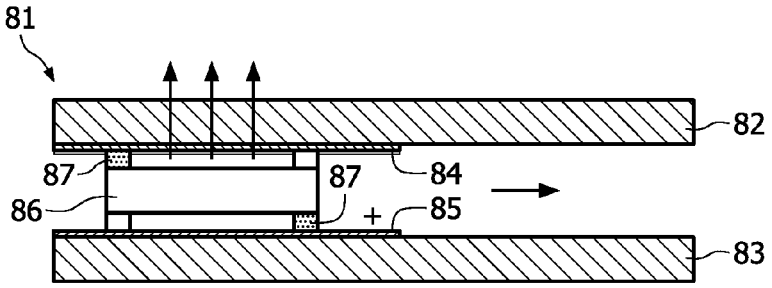
FIGS. 6*a,b,c,d* show details of embodiments of the sliding electric connections in a light system according to the invention.
Figure 6B:
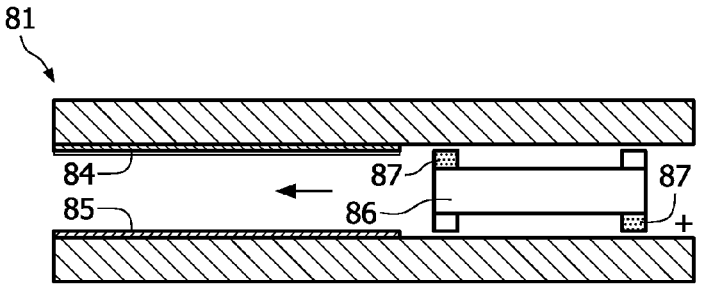

FIG. 6*a* shows a light system 81, that may be used in the drawing board according to FIG. 5, having a top transparent layer 82 and a bottom layer 83, wherein the top layer is provided with a first electrode 84 (in this case an anode) and the opposite layer 85 is provided with a counter electrode (in this case the cathode). The light element 86 is provided with suitable contacts 87, leading to the emitting of light when the light element 86 is positioned according to FIG. 6*a*. However, when the light element is displaced to a position wherein the contacts 87 do not connect to electrical power means, as is the case in FIG. 6*b*, the light element 86 does not emit light en is thus effectively switched off.

Figure 6C:
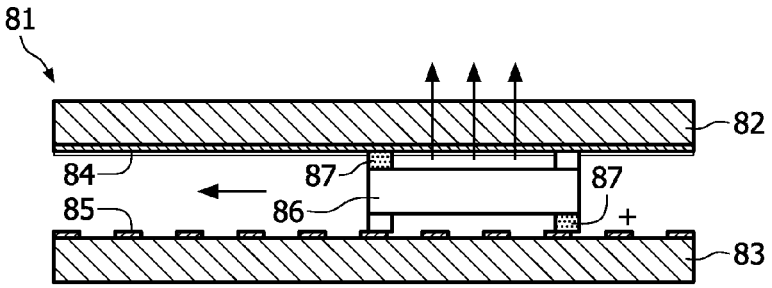

FIG. 6*c* shows an alternative to FIG. 6*a*, having an anode layer 84 on the top substrate 83, but having a discontinuous cathode layer 85 on the bottom substrate 83. Hence, when moving the light element 86, the contacts 87 pass positions wherein the contact with the cathode 85 is broken, resulting in flashing of the light element 86 during movement. It is also possible to have a different electrical potential or an electrical potential with different pulse lengths applied to various tracks, thus changing the light intensity or pattern when changing power supply tracks.

Figure 6D:
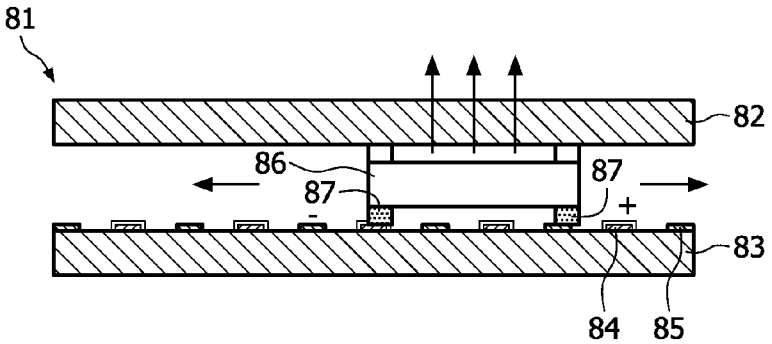

FIG. 6*d* shows another alternative embodiment, wherein the top substrate 82 does not have any electrical power supply, but instead the bottom substrate 83 is provided with an alternating pattern of cathode 84 and anode 85 tracks for supplying power to the contacts 87 of the light element 86.

Figure 7A:
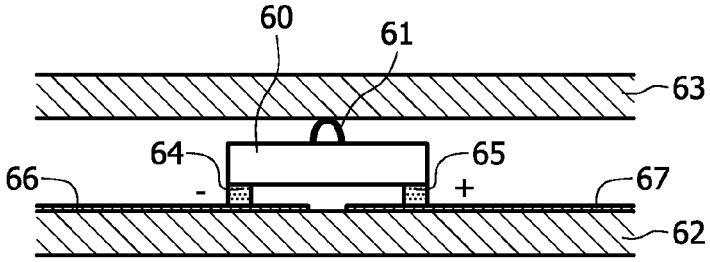
FIGS. 7*a,b,c,d,e* show further details of embodiments of the sliding electric connections in a light system according to the invention.

FIG. 7*a* shows an embodiment, wherein the light element 60 is provided with a resilient element 61, exerting force on the parallel plates 62, 63. The top parallel plate 63 is of a transparent material, the lower transparent material is provided with an anode 66 and cathode 67 for powering the light element. In this embodiment, the light element 60 provided with electrical contacts 64, 65, connecting to an anode layer 66 and a cathode layer 67, respectively. When the light element 60 is to be displaced, the friction induced by the bias of the resilient element 61 needs to overcome, thus offering a temporary fixation of the light element 60 in a desired position. Also, the bias enables a good sliding electrical contact with the anode and cathode even when the light element 60 is moving.

Figure 7B:
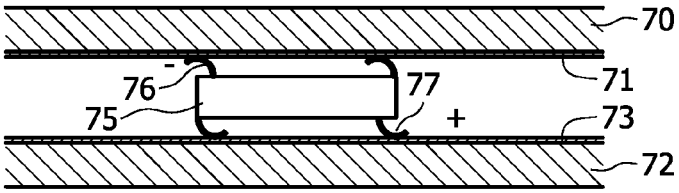

FIG. 7*b* shows an alternative embodiment, wherein the top plate 70 is provided with an anode layer 71, and the bottom plate 72 is provide with a cathode layer 73. Accordingly, the light element 74 is provided with sliding contacts 76, 77 having a resilient form, ensuring a proper power supply even during displacement of the light element.

Figure 7C:
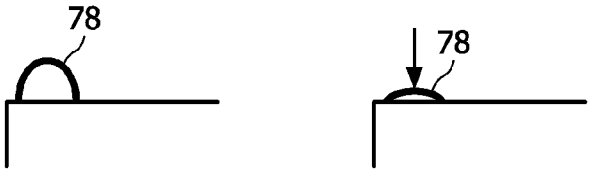
Figure 7D:
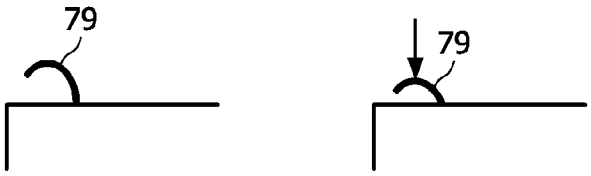
Figure 7E:
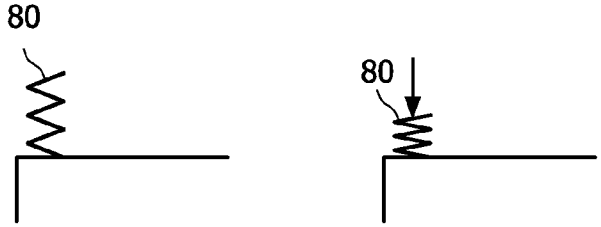

FIG. 7*c* shows a resilient sliding electrical contact 78 that may be used in a light element according to the invention. In this case, the contact 78 is an arced wire, that may be pressed as shown on the right hand figure, thus creating a bias. FIG. 7*d* shows an alternative embodiment, wherein a curved wire 79 or strip may be bent in order to create a bias. FIG. 7*e* shows an alternative wherein a spring contact 80 is used for creating a bias. Resilient electrical contacts differing from the ones shown in the figures are conceivable.

FIG. 8 shows further embodiments of light elements according to the invention.

Figure 8A:
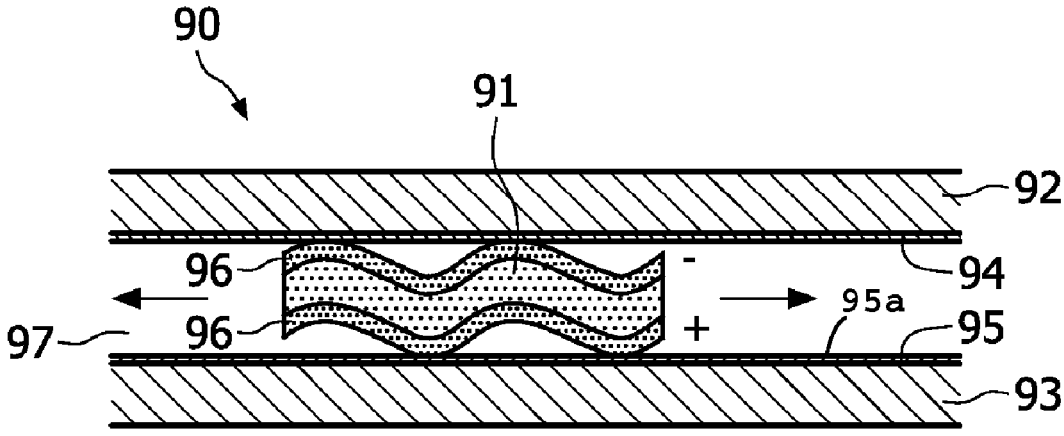
FIGS. 8*a,b,c,d,e* show further embodiments of light elements according to the invention.
Figure 8B:
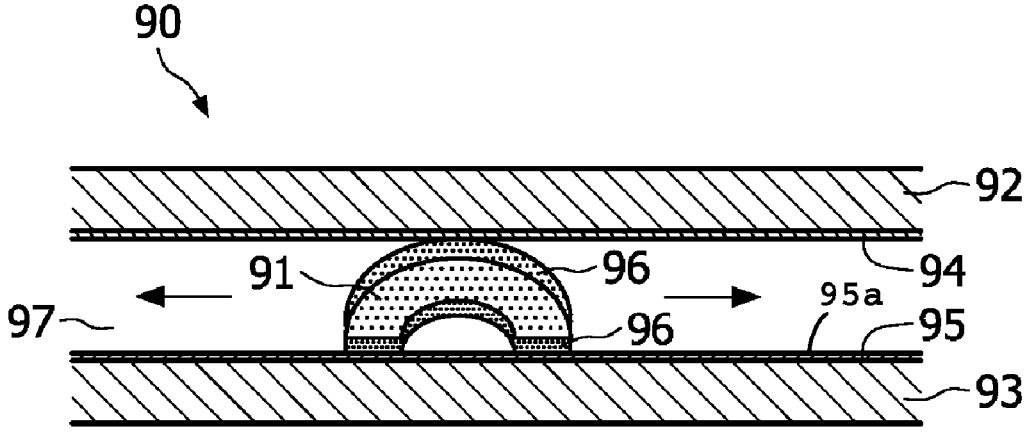

FIG. 8*a* shows a light system 90 comparable to the light systems shown above, wherein an OLED light element 91 is positioned in sliding contact with a top plate 92 and a bottom plate 93, wherein the top plate is provided with an anode layer 94 and the bottom plate is provided with a cathode 95. The OLED is shaped in a resilient wavy form, providing a bias pressing the contact layers 96 of the OLED against the anode and cathode. When friction is overcome, the OLED can be moved in the space 97 between the plates 92, 93. Curved OLEDs offer a very simple and elegant way to provide both a light element as well as resilient means to provide a bias for fixing the light element. OLEDs having various curved forms may be used instead of the wavy form shown in FIG. 8*a*. For instance, FIG. 8*b* shows an arced OLED. The top plate 92 and bottom plate 93 in FIGS. 8*a* and 8*b* may be both transparent. Alternatively, the bottom plate 93 is not transparent, but instead is provided with a metallic light-reflecting cathode 95, for instance in the form of a layer made of copper or another suitable metal or metal alloy, the surface 95*a* of which is light-reflecting. The use of a metal layer as a cathode 95 enables a good heat-management of the device through the excellent heat-conducting properties of the metal, as well as optimizing light intensity as emitted through the transparent top plate 92 by using the cathode 95 as a light reflector. Instead of a metallic layer as a cathode 95, it is also possible to use a completely metallic substrate 93, which acts as a heat sink for further improved temperature control of the device 97.

Figure 8D:
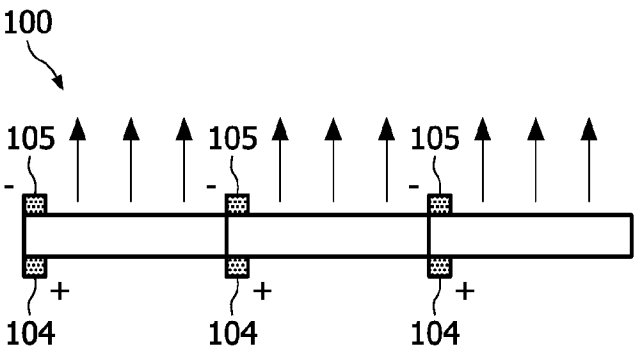
Figure 8C:
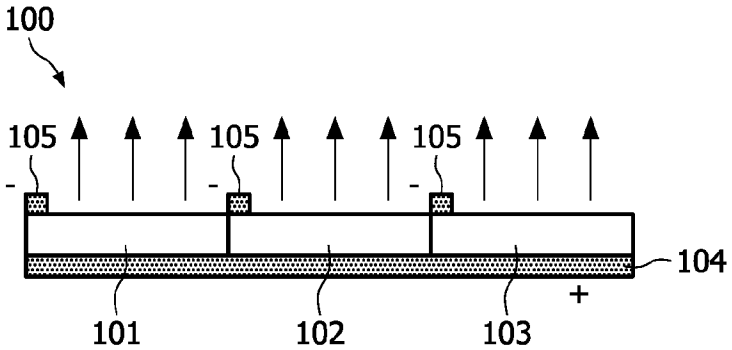

FIG. 8*c* shows a lighting element 100 wherein three LEDs 101, 102, 103 having different colours (for instance red, green and blue) are grouped together, sharing an anode contact layer 104, but having separate cathode contacts 105. The anode contacts may have any form, for instance the resilient contacts shown in FIGS. 7*a-e*. Using such a light element on a grated cathode (for instance FIG. 6 *c*) would result in a change of colour depending on the position of the light element 100, whereas the position of the light element would determine which of the different colours would be switched on and off.

FIG. 8*d* describes a LED assembly comparable to FIG. 3*c*, where both sides are provided with electrical contacts 104, 105. Preferably, at least on one side of the LED assembly, the contacts 104, 105 are resilient contacts such as the examples shown in FIGS. 7*a-e*.

Figure 8E:
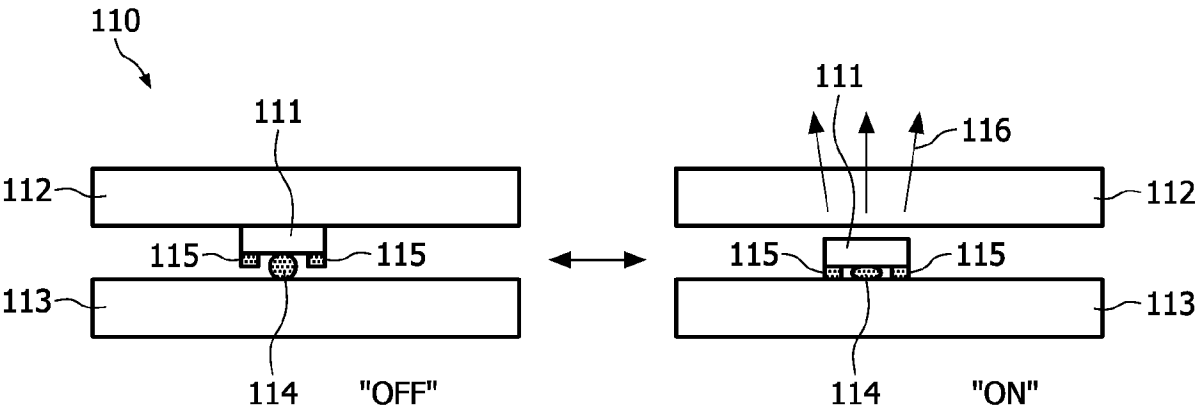

FIG. 8*e* describes another embodiment of a light system 110, wherein the light element 111 is a laser element located between a transparent substrate 112 and a conducting substrate 113, provided with electrically conducting tracks. The light element 111 is provided with a heat-responsive expandable organ 114. In the 'off' position, the organ is expanded, thus keeping the electrical contacts 115 away from the conducting substrate 113. In the 'on' position, the expandable organ 114 is deflated, having a smaller volume, thus allowing the contacts 115 to be powered through the conducting substrate 113, leading to the emitting of light 116. It is possible to switch between the 'on' and 'off' positions in a reversible manner. The heating of the heat-responsive organ 114 can be done by heating means, for instance heating tracks on the conducting surface or irradiation by infrared. Instead of a laser element 111, a LED or OLED could be used in a similar manner.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. Lighting system, comprising a first substrate and a second substrate enclosing a space therebetween, each substrate comprising electrical power means, at least one part of the first and second substrates being at least partially transparent, wherein the space between the substrates contains at least one electrical light element displaceable with respect to the substrates, and comprising sliding electrical connectors for powering the light element in sliding electrical contact with the electrical power means.

2. Lighting system according to claim 1, wherein at least part of the multiple light elements are displaceable independently of each other.

3. Lighting system according to claim 1, wherein the light element is selected from the group consisting of: inorganic light emitting diodes (LEDs), organic light emitting diodes (OLEDs) and lasers.

4. Lighting system according to claim 1, wherein both substrates are at least partially transparent.

5. Lighting system according to claim 1, wherein the first substrate is transparent and the second substrate, opposite to the transparent substrate, is provided with a reflective surface.

6. Lighting system according to claim 1, wherein the electrical power means comprise at least one anode and at least one cathode covering adjacent areas on the same substrate, wherein the connectors of the light element are adapted to contact the anode and the cathode in a connecting position.

7. Lighting system according to claim 6, wherein a first connector of the light element is located at a distal end of the light element, and a second connector of the light element is located at another distal end of the light element, opposite to the first connector.

8. Lighting system according to claim 6, wherein at least one anode covers at least part of a first substrate, and at least one cathode covers at least part of the opposite substrate, wherein the connectors of the light element are adapted to contact the anode and the cathode simultaneously in a connecting position.

9. Lighting system according to claim 8, wherein a first connector of the light element is located on top of the light element, and a second connector of the light element is located on the bottom of the light element, opposite to the first connector.

10. Lighting system according to claim 6, wherein the anode and/or the cathode only cover part of the substrate, such that in at least a 'on' position with respect to the substrate the connectors means connect to both the anode and the cathode, powering the light element, whereas in at least an 'off' position with respect to the substrate the connectors do not connect both the anode and the cathode.

11. Lighting system according to claim 6, wherein the light element is provided with biasing means for biasing the connectors against the anode and/or the cathode.

12. Lighting system according to claim 1, wherein the lighting system is provided with fixing means for fixing the light element on a predetermined position with respect to the substrate.

13. Lighting system according to claim 1, comprising driving means for displacing the light element.

* * * * *